US011484111B2

(12) United States Patent
Chiang

(10) Patent No.: US 11,484,111 B2
(45) Date of Patent: Nov. 1, 2022

(54) BRUSH STRUCTURE

(71) Applicant: Shih Chih Chiang, Taichung (TW)

(72) Inventor: Shih Chih Chiang, Taichung (TW)

( * ) Notice: Subject to any disclaimer, the term of this patent is extended or adjusted under 35 U.S.C. 154(b) by 102 days.

(21) Appl. No.: 17/106,985

(22) Filed: Nov. 30, 2020

(65) Prior Publication Data

US 2022/0167732 A1 Jun. 2, 2022

(51) Int. Cl.
*A46B 7/04* (2006.01)
*A46B 9/04* (2006.01)
*A46B 9/06* (2006.01)

(52) U.S. Cl.
CPC ..... *A46B 7/044* (2013.01); *A46B 9/04* (2013.01); *A46B 9/06* (2013.01); *A46B 2200/1066* (2013.01)

(58) Field of Classification Search
None
See application file for complete search history.

(56) References Cited

U.S. PATENT DOCUMENTS 1,633,894 A * 6/1927 Kellogg ..... A46B 15/00 15/202
1,671,334 A * 5/1928 White ..... A46B 7/04 132/142
1,685,328 A * 9/1928 Kogler ..... A45B 3/10 15/202
2,238,603 A * 4/1941 Runnels ..... A46B 7/044 132/142
4,633,542 A * 1/1987 Taravel ..... A46B 7/06 15/201
4,694,844 A * 9/1987 Berl ..... A46B 3/00 132/308
5,307,861 A * 5/1994 Townsend ..... A46B 7/06 164/428
5,524,319 A * 6/1996 Avidor ..... A46B 7/06 15/201
2005/0039976 A1* 2/2005 Vu ..... F16F 1/374 181/209
2007/0158886 A1* 7/2007 Gedenk ..... F16F 1/44 267/64.21

FOREIGN PATENT DOCUMENTS

WO WO-9302591 A1 * 2/1993 ..... A46B 7/06

* cited by examiner

*Primary Examiner* — Joseph J Hail
*Assistant Examiner* — Dana Lee Poon
(74) *Attorney, Agent, or Firm* — Rosenberg, Klein & Lee

(57) ABSTRACT

A brush structure contains: a holder and multiple cleaning assemblies. The holder includes multiple ribs. A respective cleaning assembly includes a positioning element, a brushing unit, at least one flexible element, and a support plate. The respective cleaning assembly is accommodated in a respective receiving groove by using the positioning element, and a top of the positioning element is engaged by a respective rib. The positioning element has an accommodation orifice defined therein, and the positioning element has a stop shoulder extending from an inner wall of a top thereof. The brushing unit has a base and multiple brushes mounted on the base, the base is received in the accommodation orifice of the positioning element, and the multiple brushes extend out of the accommodation orifice and are stopped by the stop shoulder. The at least one flexible element abuts against the base and the support plate.

3 Claims, 10 Drawing Sheets

BRUSH STRUCTURE

FIELD OF THE INVENTION

The present invention relates to brush structure which includes multiple cleaning assemblies.

BACKGROUND OF THE INVENTION

A conventional brush structure contains a holder, multiple brushes mounted on the holder of an end of a brush so as to brush teeth. However, the multiple brushes are mounted on the holder directly, so it is difficult to brush the teeth having uneven surfaces.

The present invention has arisen to mitigate and/or obviate the afore-described disadvantages.

SUMMARY OF THE INVENTION

The primary aspect of the present invention is to provide a brush structure which contains a brushing unit and at least one flexible element so as to brush an irregular object and an irregular projected object matingly and cleanly.

Further aspect of the present invention is to provide a brush structure which is applied to brush various objects.

Another aspect of the present invention is to provide a brush structure which is manufactured flexibly, for example, the brush structure contains at least one flexible element formed in a sheet shape and is made of plastic or metal, a hollowly flexible column or two flexible elements formed in a solid ball shape.

To obtain above-mentioned aspects, a brush structure provided by the present invention contains: a holder and multiple cleaning assemblies.

The holder includes multiple ribs.

A respective cleaning assembly includes a positioning element, a brushing unit, at least one flexible element, and a support plate.

The respective cleaning assembly is accommodated in a respective receiving groove by using the positioning element, and a top of the positioning element is engaged by a respective rib.

The positioning element has an accommodation orifice defined therein, and the positioning element has a stop shoulder extending from an inner wall of a top thereof.

The brushing unit has a base and multiple brushes mounted on the base, the base is received in the accommodation orifice of the positioning element, and the multiple brushes extend out of the accommodation orifice and are stopped by the stop shoulder.

The at least one flexible element abuts against the base and the support plate.

DETAILED DESCRIPTION OF THE PREFERRED EMBODIMENTS

Figure 1:
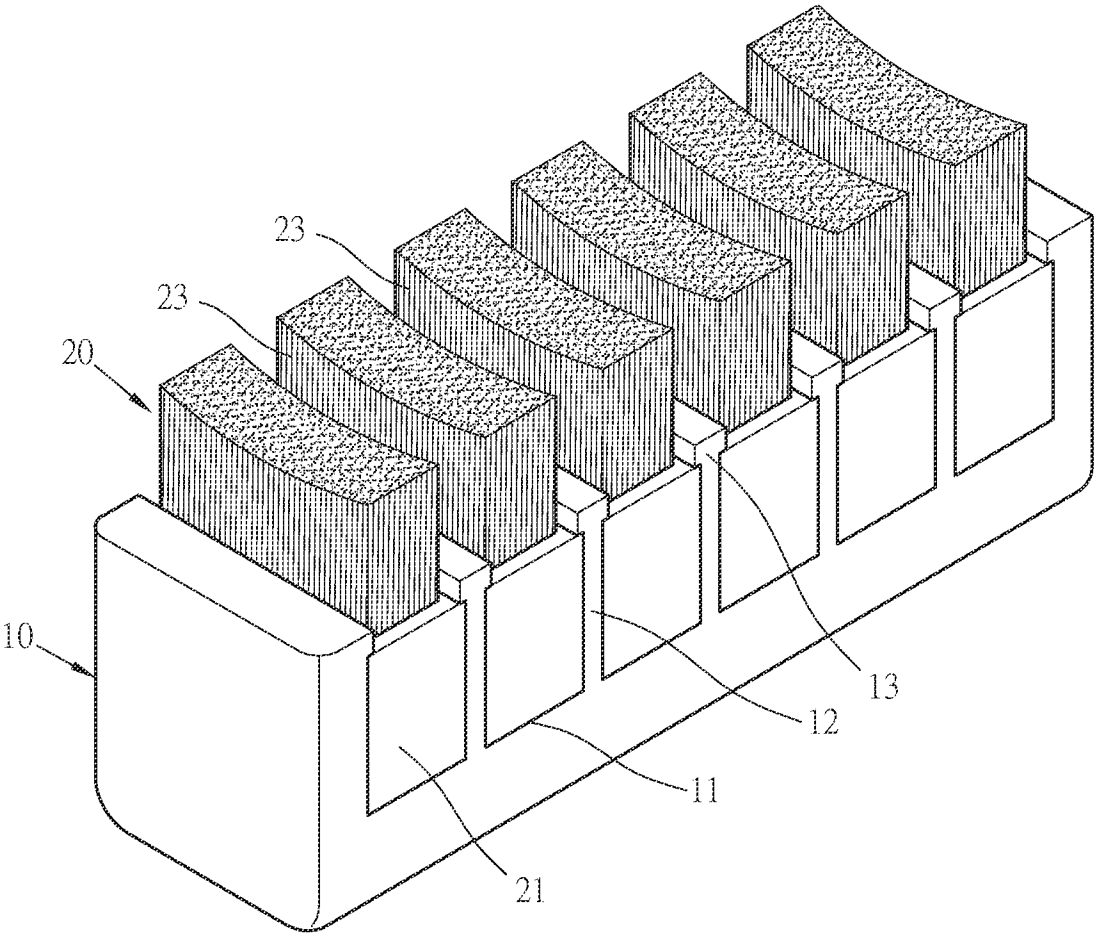
FIG. 1 is a perspective view showing the assembly of a brush structure according to a first embodiment of the present invention.
Figure 2:
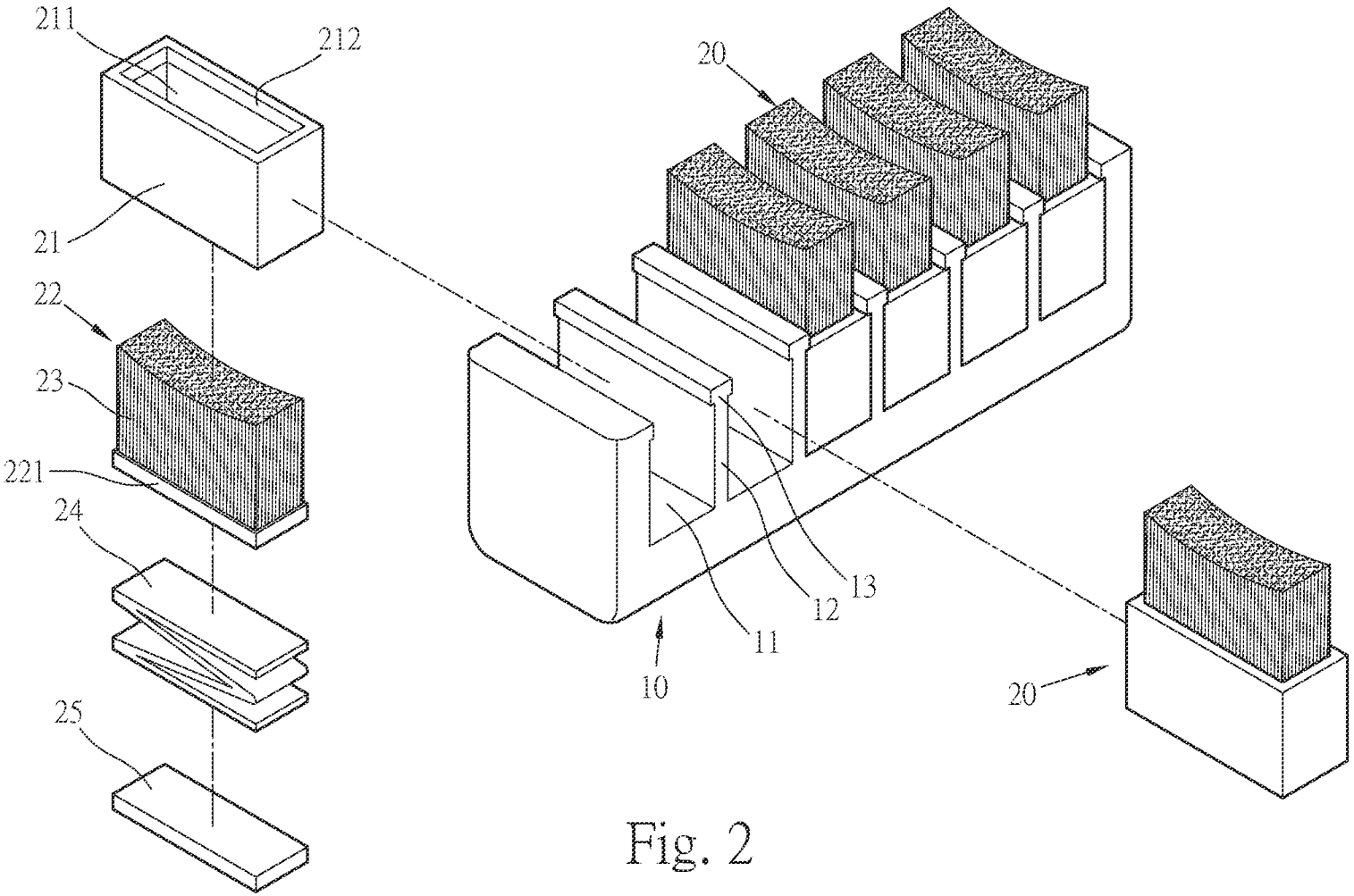
FIG. 2 is a perspective view showing the exploded components of the brush structure according to the first embodiment of the present invention.

With reference to FIGS. 1 and 2, a brush structure according to a first embodiment of the present invention comprises: a holder 10 and multiple cleaning assemblies 20 fixed on the holder 10.

The holder 10 is formed in a cuboid shape, and the holder 10 includes multiple receiving grooves 11 separately defined thereon, multiple partitions 12, and multiple ribs 13 extending on ends of the multiple partitions 12, wherein a respective partition 12 is defined between any two adjacent receiving grooves 11, and a respective rib 13 is formed in a T shape.

Figure 3:
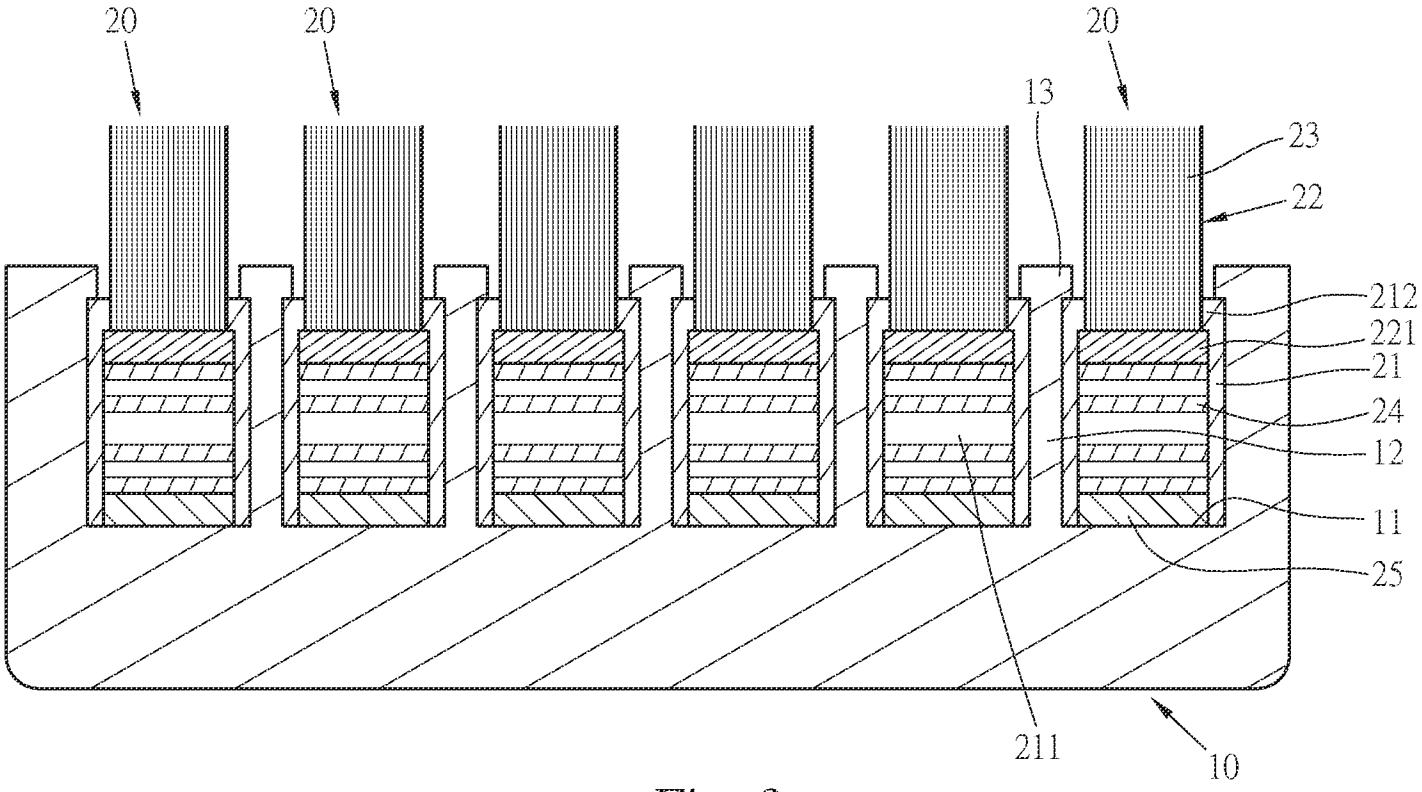
FIG. 3 is a cross sectional view showing the assembly of the brush structure according to the first embodiment of the present invention.

A respective cleaning assembly 20 includes a positioning element 21, a brushing unit 22, at least one flexible element 24, and a support plate 25, as shown in FIGS. 2 and 3, wherein the positioning element 21 is formed in a hollowly cuboid shape and is accommodated in a respective receiving groove 11, and a top of the positioning element 21 is engaged by the respective rib 13 so as to avoid a removal of the positioning element 21 from the holder 10. The positioning element 21 has an accommodation orifice 211 defined therein, and the positioning element 21 has a stop shoulder 212 extending from an inner wall of a top thereof, wherein a size of an opening of the positioning element 21 inside the stop shoulder 212 is less than a size of the accommodation orifice 211.

The brushing unit 22 has a base 221 and multiple brushes 23 mounted on the base 221, wherein the base 221 is received in the accommodation orifice 211 of the positioning element 21, and the multiple brushes 23 extend out of the accommodation orifice 211 and are stopped by the stop shoulder 212. The at least one flexible element 24 is formed in a sheet shape and is made of plastic or metal, wherein a respective flexible element 24 abuts against a bottom of the base 221 and is received in the accommodation orifice 211 of the positioning element 21, and the support plate 25 is received in the accommodation orifice 211 of the positioning element 21 matingly so as to abut against the brushing unit 22. In assembly, the support plate 25 is disposed on the respective flexible element 24, the respective flexible element 24 is fixed on the brushing unit 22, and the support plate 25, the respective flexible element 24 and the brushing unit 22 are received in the accommodation orifice 211 of the positioning element 21 until the multiple brushes 23 extend out of the accommodation orifice 211, wherein the stop shoulder 212 stops the base 221 so as to form the respective cleaning assembly 20, the respective cleaning assembly 20 is pushed into the respective receiving groove 11 by using the positioning element 21, and the respective rib 13 abuts against the top of the positioning element 21 of the respective cleaning assembly 20 so that the multiple brushes 23 extend out of the respective receiving groove 11, and the respective cleaning assembly 20 is received in the respective receiving groove 11 by way of the positioning element 21 of the respective cleaning assembly 20, thus accommodating the respective cleaning assembly 20 in the respective receiving groove 11 of the holder 10, as shown in FIGS. 1 and 4.

Figure 4:
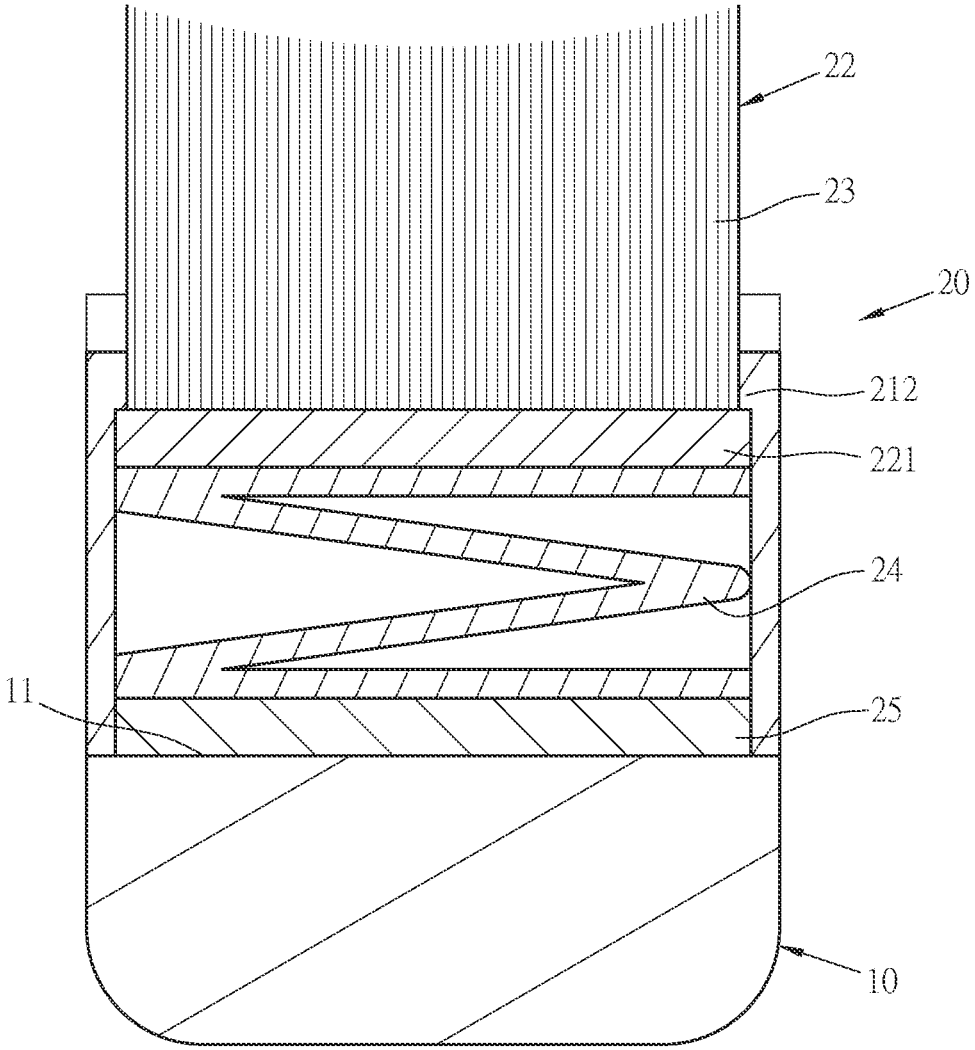
FIG. 4 is a cross sectional view showing the assembly of a part of the brush structure according to the first embodiment of the present invention.
Figure 5:
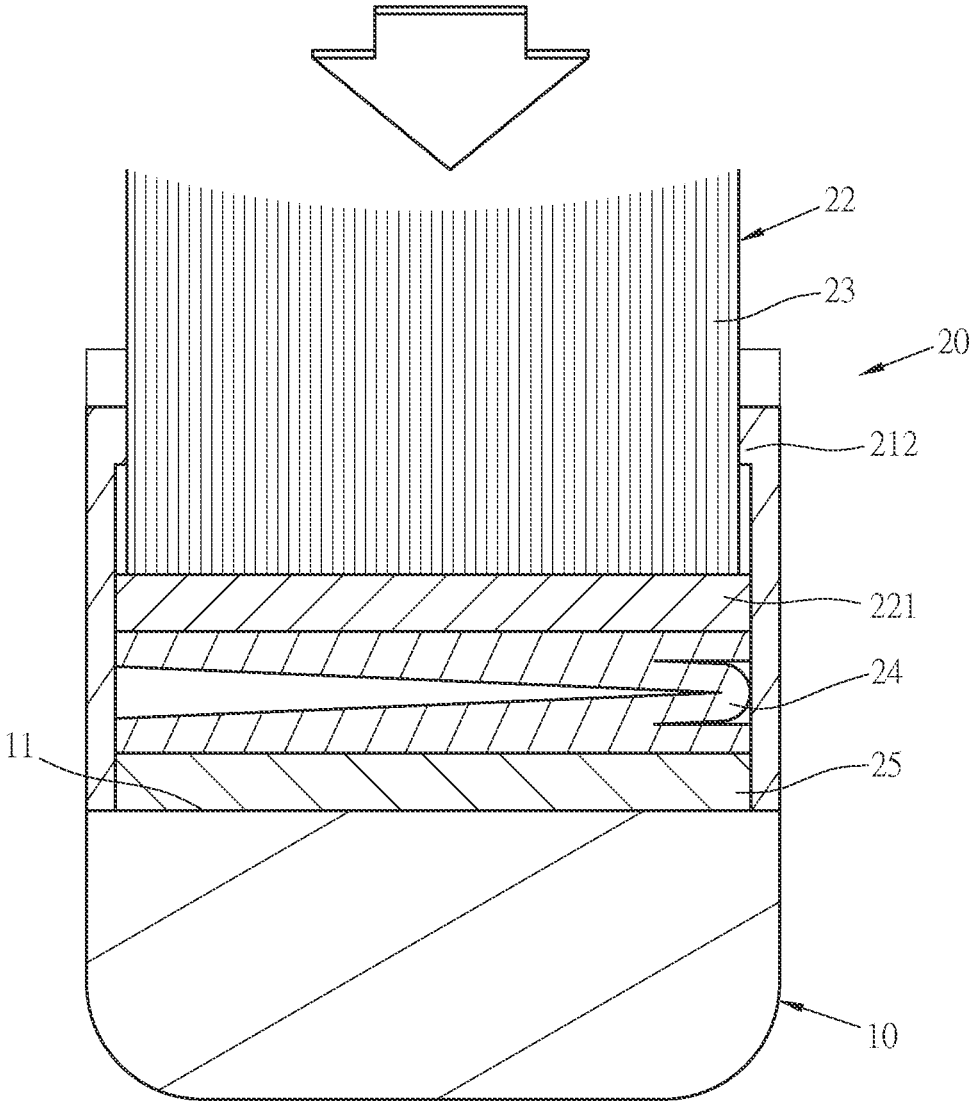
FIG. 5 is a cross sectional view showing the operation of the brush structure according to the first embodiment of the present invention.
Figure 6:
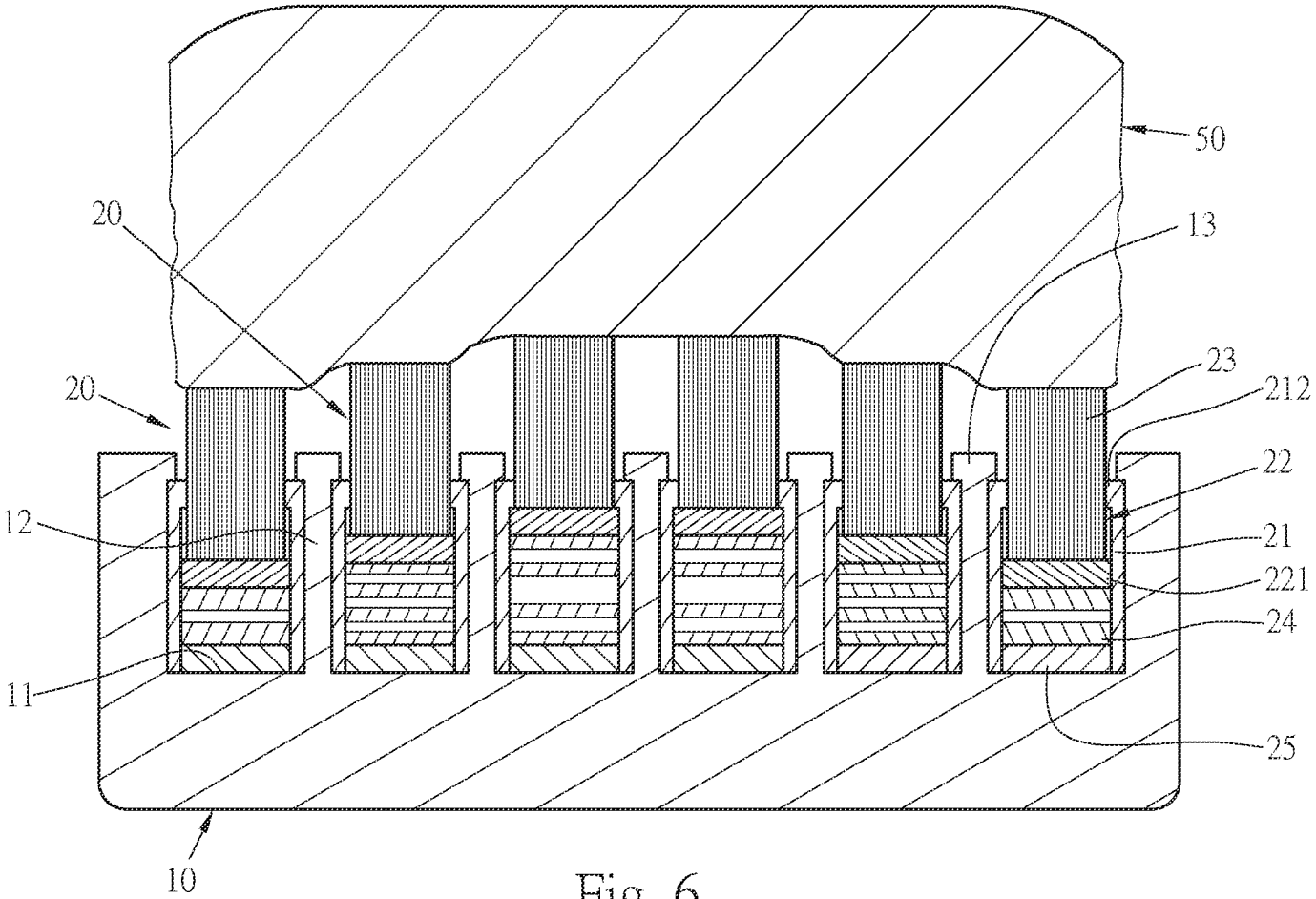
FIG. 6 is another cross sectional view showing the operation of the brush structure according to the first embodiment of the present invention.

In use, as shown in FIGS. 4-6, when the brush structure brushes an irregular projected object 50, the multiple brushes 23 of the holder 10 contact with the irregular projected object 50, and the holder 10 brushes the irregular projected object 50 repeatedly, such that the brushing unit 22 presses the respective flexible element 24 to release its pressed force in the positioning element 21, a portion of a respective brush 23 is received in the accommodation orifice 211 so as to decrease its extending length out of the respective receiving groove 11, and a distal end of the respective brush 23 contacts with the irregular projected object 50 matingly. On the contrary, when the brush structure brushes an irregular concaved object 50, a reaction force of the irregular projected object 50 against the brushing unit 22 is less a brushing force of the brush structure, a pressed elasticity of the respective flexible element 24 reduces so that the extending length of the respective brush 23 out of the respective receiving groove 11 increases but the respective brush 23 contacts with the irregular concaved object 50 matingly. Accordingly, the brush structure brushes the irregular projected object and the irregular concaved object matingly. In other words, the respective cleaning assembly 20 of the holder 10 is applicable for different brushing pressures by using the respective flexible element 24 to adjust the extending length of the respective brush 23 out of the respective receiving groove 11, hence the respective brush 23 cleans the irregular projected object and the irregular concaved object matingly.

Figure 7:
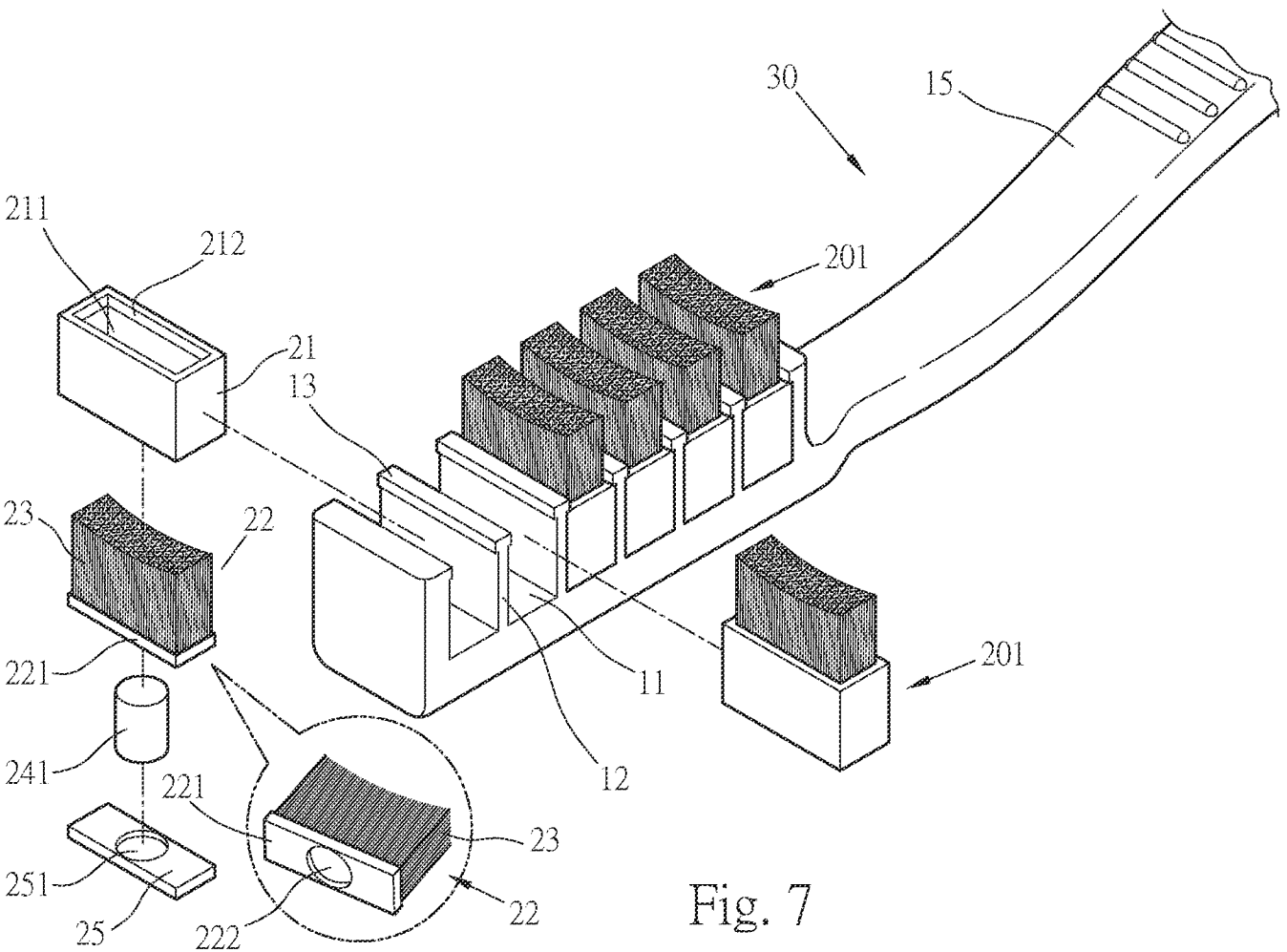
FIG. 7 is a perspective view showing the assembly of a brush structure according to a second embodiment of the present invention.
Figure 8:
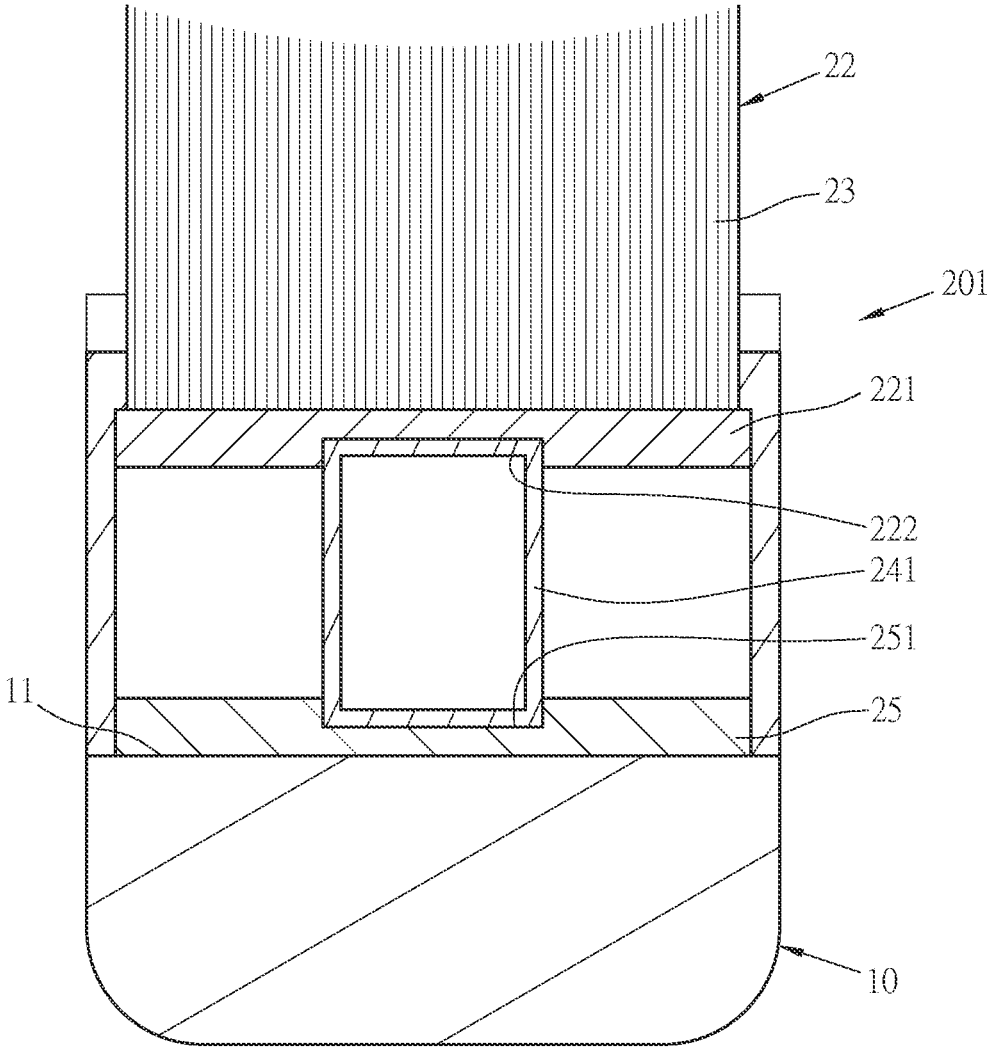
FIG. 8 is a cross sectional view showing the assembly of a part of the brush structure according to the second embodiment of the present invention.

In a second embodiment, as shown in FIGS. 7 and 8, the holder 10 includes a grip 15 extending from an end thereof so as to form a toothbrush 30 which includes multiple cleaning assemblies 201. In addition, the base 221 of the brushing unit 22 has a first notch 222, and the support plate 25 has a second notch 251, such that a hollowly flexible column 241 is accommodated in the first notch 222 and the second notch 251 and is applicable for a respective cleaning assembly 201.

Figure 9:
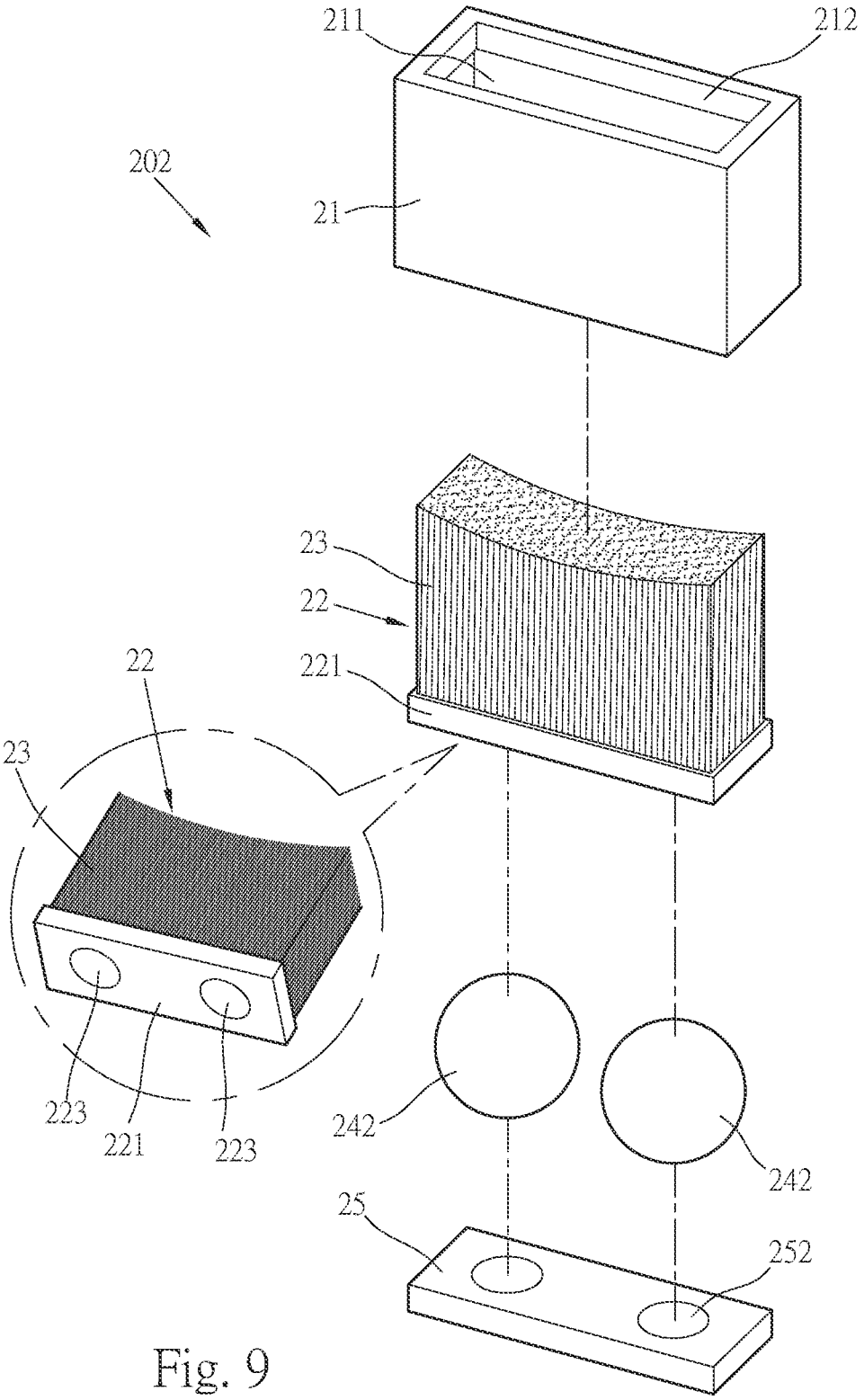
FIG. 9 is a perspective view showing the assembly of a brush structure according to a third embodiment of the present invention.
Figure 10:
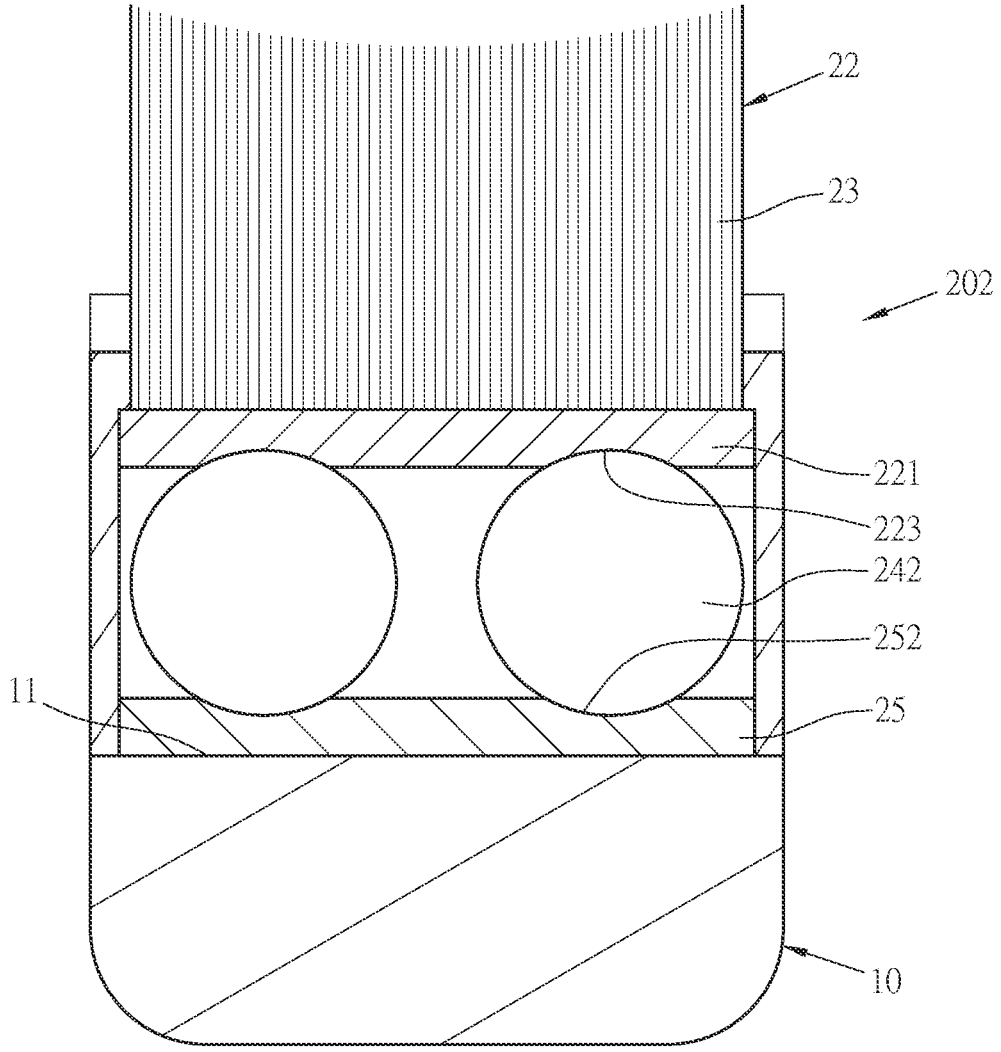
FIG. 10 is a cross sectional view showing the assembly of a part of the brush structure according to the third embodiment of the present invention.

Referring to FIGS. 9 and 10, the holder 10 is a single brush configured to brush an object, wherein a respective cleaning assembly 202 includes two flexible elements 242 formed in a solid ball shape. In addition, the base 221 of the brushing unit 22 has two first notches 223, and the support plate 25 has two second notches 252, such that a respective flexible element 242 is accommodated in a respective first notch 223 and a respective second notch 252 and is applicable for the respective cleaning assembly 202.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A brush structure, comprising:

a holder and multiple cleaning assemblies fixed on the holder, the holder including multiple spaced-apart receiving grooves formed thereon in adjacent relationship to one another, and the holder also including multiple ribs formed thereon;

each cleaning assembly including a positioning element, a brushing unit, two flexible elements formed in a solid ball shape, and a support plate;

wherein each cleaning assembly is accommodated in a corresponding one of the receiving grooves whereby a positioning element of each cleaning assembly is securely received in a corresponding one of the receiving grooves, and a top of the positioning element of each cleaning assembly being engaged by a corresponding one of the ribs;

wherein the positioning element of each cleaning assembly has an accommodation orifice defined therein, and a stop shoulder extending from an inner section of the top of the positioning element;

wherein the brushing unit of each cleaning assembly has a base and multiple brushes mounted on the base, the base of the brushing unit of each cleaning assembly being received in the accommodation orifice of the positioning element of the respective cleaning assembly, and the multiple brushes of each brushing unit extend out of the accommodation orifice of the respective positioning element and stopped by a corresponding stop shoulder; and wherein the base of the brushing unit of each cleaning assembly has two first notches and the support plate of each cleaning assembly has two second notches, wherein each of the two flexible elements is accommodated in a respective one of each of the first notches and corresponding second notches.

2. The brush structure as claimed in claim 1, wherein the holder includes multiple partitions and an end of each of the multiple partitions have extending therefrom a corresponding rib, wherein each of the multiple partitions is defined between two adjacent receiving grooves, and each of the multiple ribs being formed in a T shape.

3. The brush structure as claimed in claim 1, wherein the stop shoulder of the positioning element of each cleaning assembly extends from an inner wall of the top of the positioning element.

* * * * *